US005863109A

United States Patent [19]

Hsieh

[11] Patent Number: 5,863,109

[45] Date of Patent: Jan. 26, 1999

[54] PHANTOM COLOR LIGHT MIRROR

[76] Inventor: Chung-Tai Hsieh, 3F, No. 22-2, Kung-Chien W. Rd., Keelung, Taiwan

[21] Appl. No.: 767,623

[22] Filed: Dec. 17, 1996

Related U.S. Application Data

[63] Continuation-in-part of Ser. No. 559,570, Nov. 16, 1995, abandoned.

[51] Int. Cl.[6] ..... F21V 5/00; F21V 1/00; G09F 13/00; G09F 13/12

[52] U.S. Cl. ..... 362/245; 362/735; 362/236; 362/244; 362/806; 40/442; 40/444; 40/219; 40/900

[58] Field of Search ..... 362/245, 806, 362/807, 812, 235, 236, 244; 40/219, 442, 444, 463, 900

[56] References Cited

U.S. PATENT DOCUMENTS

| | | | |
|---|---|---|---|
| 2,863,240 | 12/1958 | Glukes | 40/444 |
| 3,666,936 | 5/1972 | Webster, Jr. et al. | 40/444 |
| 3,790,772 | 2/1974 | Newman et al. | 40/444 |
| 3,806,722 | 4/1974 | Peake et al. | 40/444 |
| 3,824,723 | 7/1974 | Gargas | 40/463 |
| 4,173,038 | 10/1979 | Kiefer | 40/444 |
| 4,807,378 | 2/1989 | Bell | 362/812 |
| 4,922,384 | 5/1990 | Torrence | 362/245 |
| 4,970,812 | 11/1990 | Tanaka et al. | 40/444 |
| 5,199,202 | 4/1993 | Musgrave | 40/900 |
| 5,210,967 | 5/1993 | Brown | 40/900 |
| 5,228,879 | 7/1993 | Fromm | 40/442 |
| 5,251,392 | 10/1993 | McManigal | 40/442 |
| 5,365,378 | 11/1994 | Sorko-Ram | 40/900 |

*Primary Examiner*—Sandra L. O'Shea
*Assistant Examiner*—Matthew J. Spark
*Attorney, Agent, or Firm*—Beveridge, DeGrandi, Weilacher & Young, L.L..P.

[57] ABSTRACT

A phantom color light mirror including a mirror, a plurality of colored light sources, and a central control device. The mirror is composed of a transparent sheet having a reflective layer affixed to a rear surface thereof. A plurality of lines of a sufficient width are used to engrave the reflective layer with a graphic design visible from the front side of the transparent sheet. The operation of the colored light sources are controlled by the central control device. The mirror, the light sources and the central control device may be accommodated in a cabinet. A refracting device may further be disposed behind the mirror to provide enhanced visual effects.

5 Claims, 10 Drawing Sheets

PHANTOM COLOR LIGHT MIRROR

The present invention is a continuation-in-part of U.S. Ser. No. 08/559,570 filed by the inventor filed Nov. 15, 1995, now abandoned.

BACKGROUND OF THE INVENTION

1. Field of the Invention:

The present invention relates generally to a phantom color light mirror, and more particularly to a mirror with a colored graphic design through which phantom color lights may be displayed.

2. Description of the Prior Art:

With the ordinary mirror, whether it is hung on the wall or placed on a dresser, there may only be alternations or modifications in its shape, or graphic designs may be provided on the mirror frame. It therefore lacks value-enhancing features. Another problem is that, if the mirror is hung in a dark place, it is often necessary to install a light thereon.

In U.S. Pat. No. 5,210,967, Brown teaches a hidden display mirror in which a transparent front sheet has a reflective sheet of silver affixed to a rear surface thereof, with a narrow groove passing through the reflective layer. The groove describes a graphic design. The groove is so narrow as to be sufficiently inconspicuous that the graphic design is hidden from view upon casual inspection, unless the light source has a high level of brilliance and sufficient light therefrom passes through the groove. The device described by Brown may act both as an ordinary mirror and as a light emitting display of the graphic design.

In the device taught by Brown, the graphic design is almost invisible upon casual inspection. Although Brown teaches that colored non-opaque stain can be provided within the etchings (grooves), since only the level of brilliance of the light source is controllable, the color of the graphic design is fixed and unchanged, and the color of the graphic design remains the same when viewed from any angle.

For those familiar with the art of chromatics, it is well known that Wundt and Helmholtz assert that orange red, green and violet blue are the three primary colors and that they provide a color-additive mixing system. In U.S. Pat. No. 2,863,240, Glukes employs the above-mentioned color mixing principle to provide a novel light source for an animated sign producing enhanced lighting effects, and which functions as a highly efficient color corrective light source.

One having ordinary skill in the art may apply the same color mixing principle to the device disclosed by Brown. Although the color of the graphic design may change as a result, the color thus changed will not have any variations.

SUMMARY OF THE INVENTION

Accordingly, a primary object of the present invention is to provide a mirror with a surface always displaying a graphic design so that the mirror functions both as a decorative display and as an ordinary mirror.

Another object of the present invention is to provide a mirror displaying a graphic design the colors of which may change.

A further object of the present invention is to provide a mirror displaying a colored graphic design which, when viewed from any angle, may display different colors.

Still another object of the present invention is to provide a mirror displaying a graphic design wherein a slide may be inserted into the mirror so that the image on the slide may be displayed through the mirror by means of a light source at the rear side of the mirror.

A still further object of the present invention is to provide a mirror displaying a graphic design mounted in a mirror frame into which or from which the mirror may be inserted or removed.

Another further object of the present invention is to provide a mirror with a colored light source at its rear side controllable by a micro-controller so that the colors or level of brilliance of a light emitting colored graphic design on the mirror may change in many ways.

Yet another object of the present invention is to provide a mirror cabinet accommodating a series of light sources the light emitted therefrom may be refracted to the rear side of the mirror so that the colored light emitting through a colored graphic design on the mirror may be more uniform.

In order to achieve the above objects, lines of a sufficient width are used to engrave a graphic design on the rear surface of the mirror, which is then coated with a transparent light-diffusing layer, and a plurality of colored light sources controllable by a central control device are disposed in close proximity to the graphic design. The light-diffusing layer may also be colored. Therefore, when the colored light sources at the rear side of the mirror are controlled to emit lights of different colors, different mixed colors may be displayed. Besides, due to the difference in the angles of refraction of the mixed color light through the lines forming the graphic design, light of different colors may be displayed when the graphic design is viewed from different angles.

Furthermore, the mirror cabinet may be provided with a track and an opening so that the mirror may be inserted thereinto or removed therefrom. In addition, a blank space may be provided on the mirror, and a frame may be secured around the blank space so that a slide may be mounted in the frame with a light source of a high level of brilliance mounted behind the blank space to display the image on the slide. If the light sources are disposed around the rear side of the mirror with refracting devices provided behind the mirror for refracting the light from the light sources, the above-mentioned visual effects may also be achieved. Moreover, a sound generating means controllable by the central control device may be provided to generate sound or music.

BRIEF DESCRIPTION OF THE DRAWINGS

The foregoing and other features and advantages of the present invention will be more clearly understood from the following detailed description and the accompanying drawings, in which.

FIG. 6A is a sectional view taken along line C—C of

FIG. 2, illustrating the reflection of the colored light from different angles;

DETAILED DESCRIPTION OF THE PREFERRED EMBODIMENTS

Figure 1:
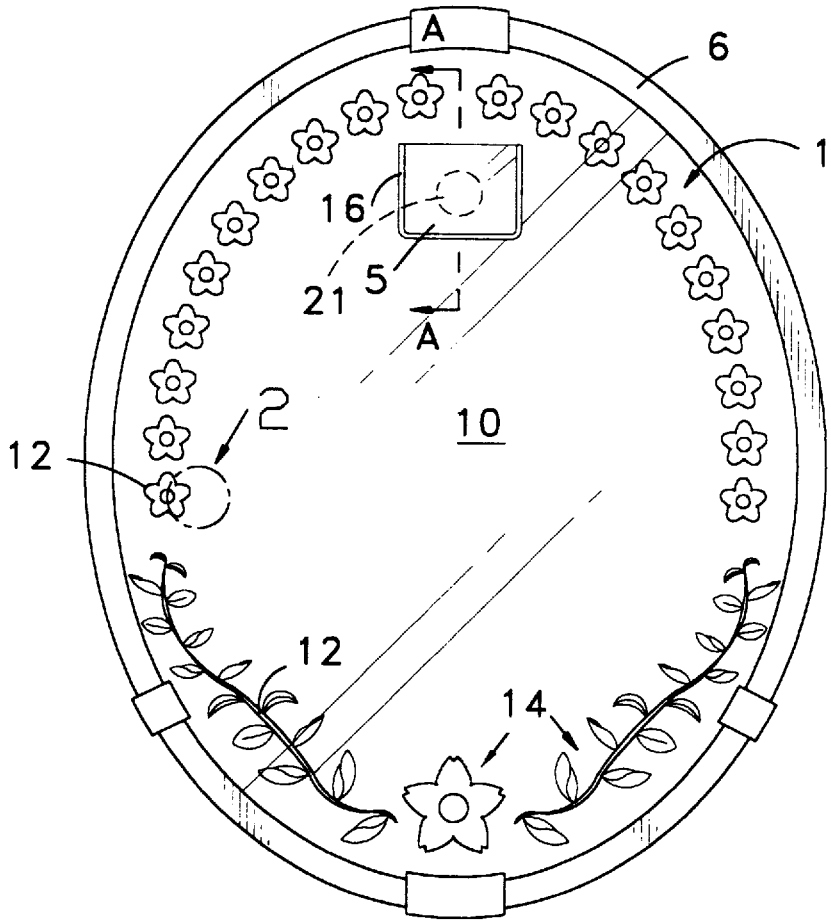
FIG. 1 is a plan view of a first preferred embodiment of the color light mirror according to the present invention.
Figure 2:
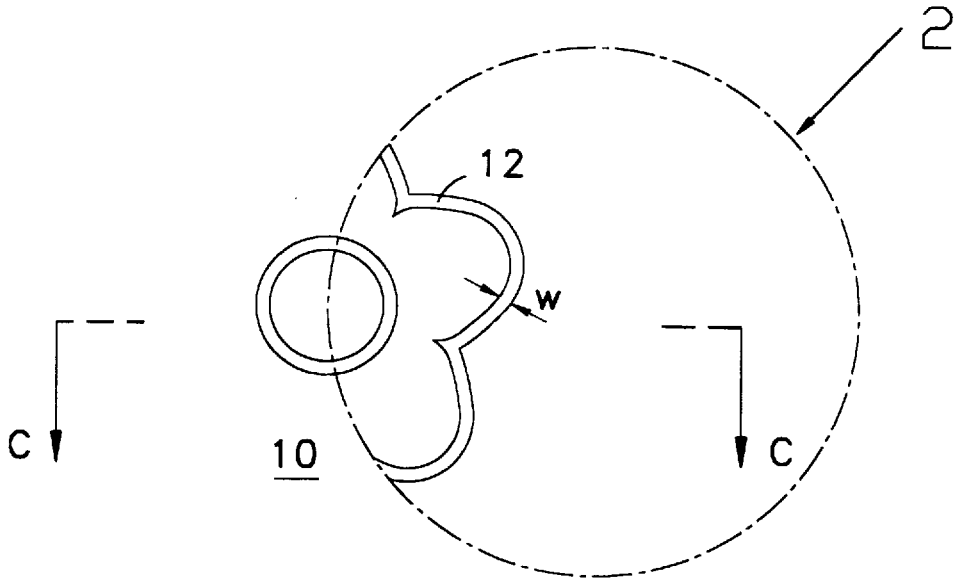
FIG. 2 is a partially enlarged view of FIG. 1.
Figure 3:
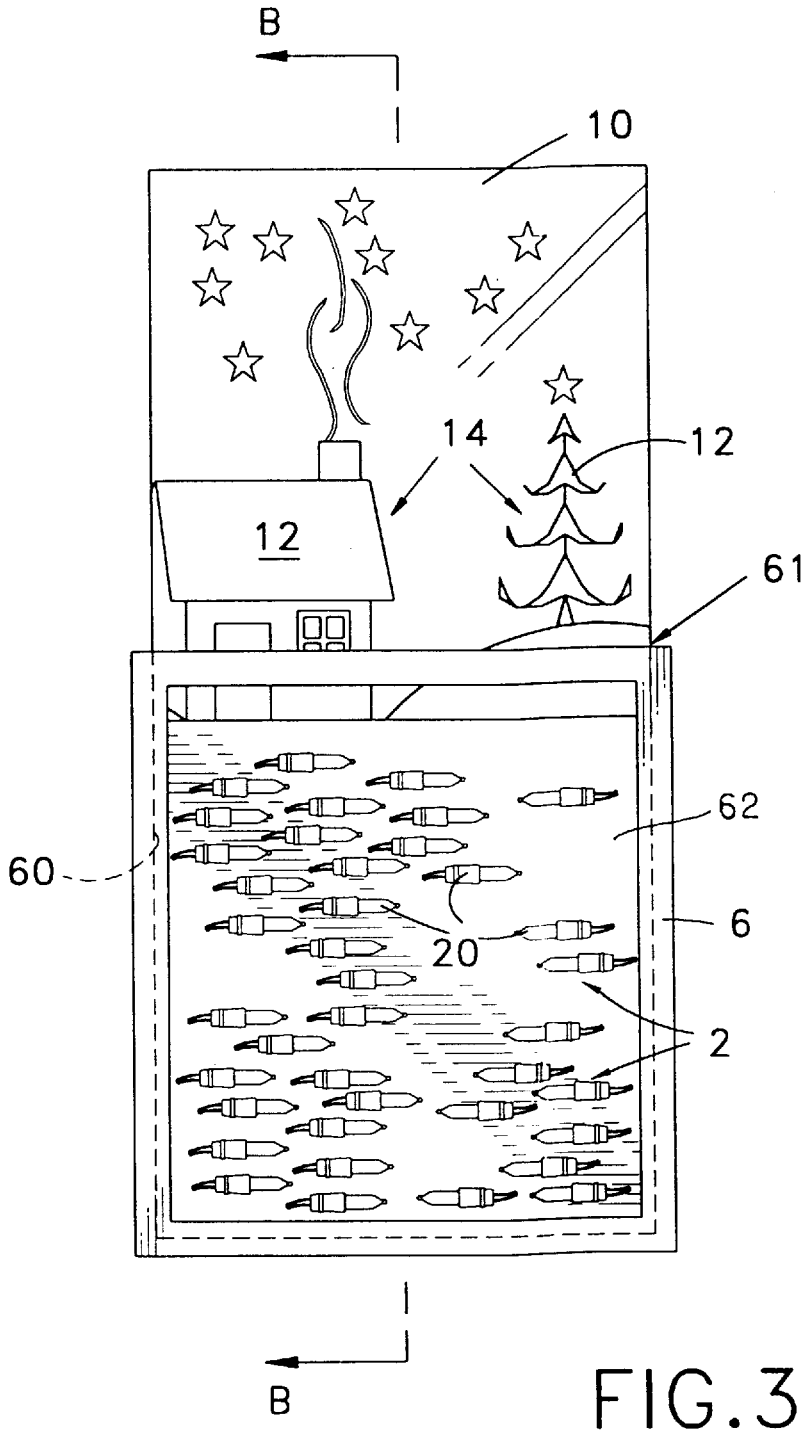
FIG. 3 is a plan view of a second preferred embodiment of the present invention, showing the mirror in a state of being pulled upwardly.
Figure 4:
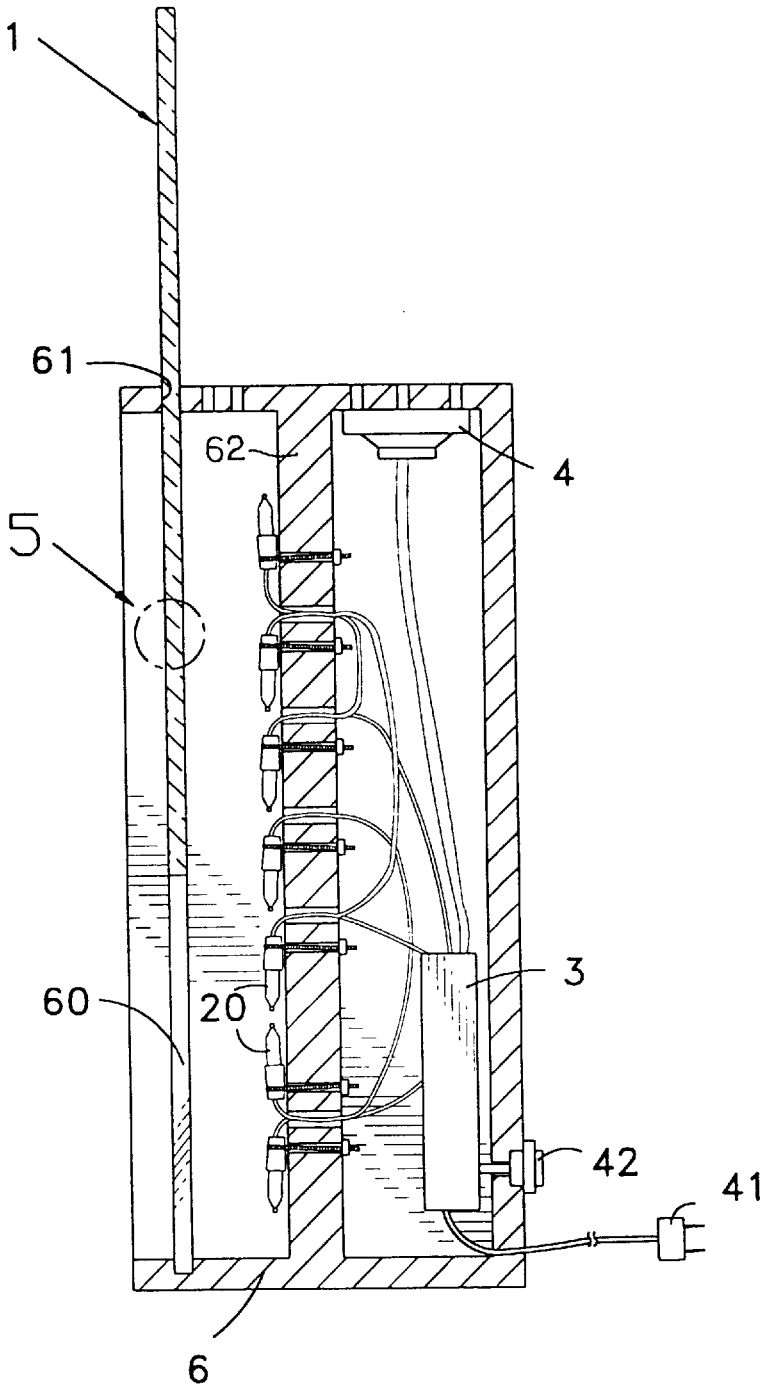
FIG. 4 is a sectional view taken along line B—B of FIG. 3.
Figure 6A:
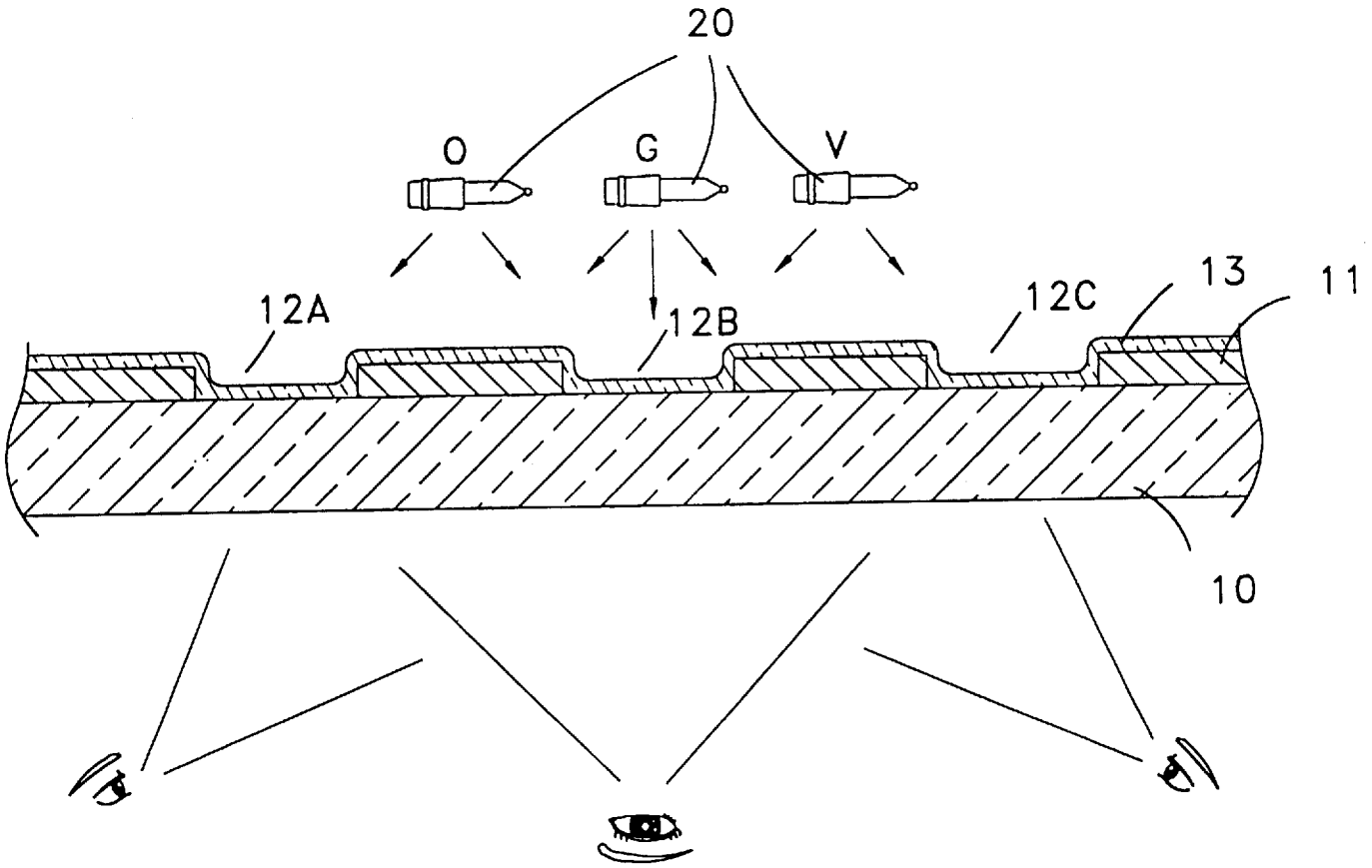
Figure 6B:
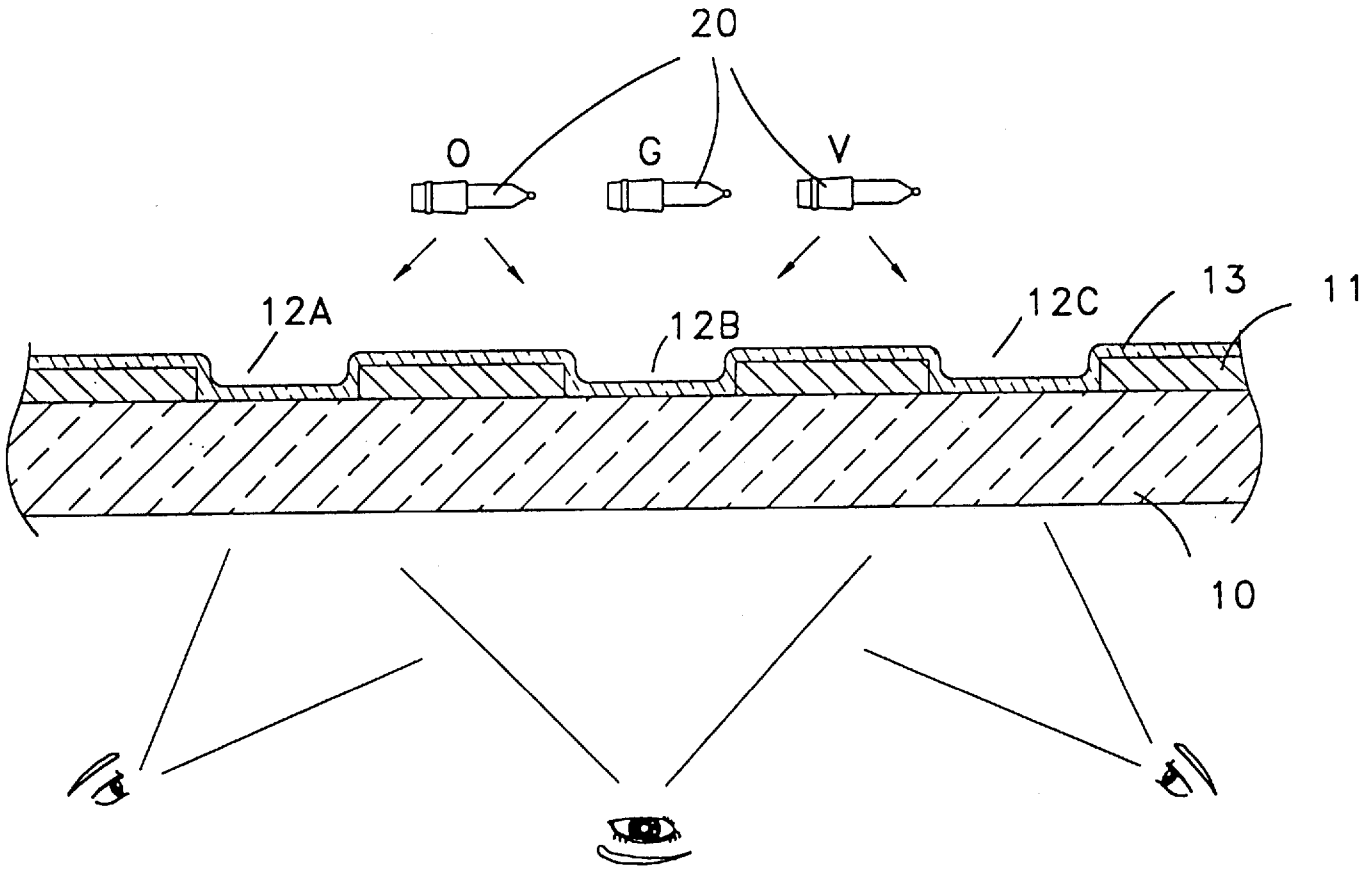
FIG. 6B is similar to FIG. 6A but showing another state.

As shown in FIGS. 1, 2 and 4, the color light mirror according to the present invention essentially comprises a cabinet 6 and a mirror 1 mounted in the cabinet 6. The mirror 1, as shown in FIG. 4, comprises a transparent sheet 10 made of glass, plastics or other materials, and a reflective layer 11 formed of such materials as mercury affixed to the rear surface of the transparent sheet 10. As shown in FIG. 2, relatively wide lines are used to engrave the reflective layer 11 to form a graphic design 14. The lines 12 should have a width W of at least 0.3 mm, even the lines 12 are wide enough to define an area (as shown in FIG. 3), or they may be wide enough to allow the graphic design 14 to be seen from the front side of the transparent sheet 10 at any time. A further effect of the relatively wide lines 12 is shown in FIGS. 6A and 6B, in which different colors may be seen through the same line 12 from different angles (as described hereinafter).

Figure 5:
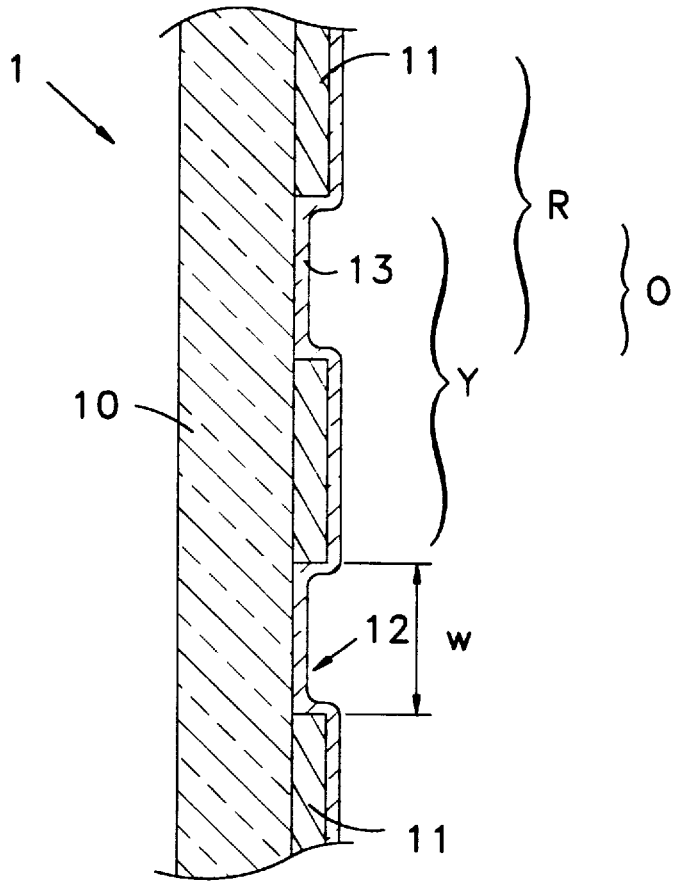
FIG. 5 is a partially enlarged view of FIG. 4.

The above-mentioned lines 12 may be formed by etching or other methods. The graphic design 14 thus formed by the lines 12 may be arranged around the borders of the mirror 1, as shown in FIG. 1, or throughout a large portion of the mirror 1, as shown in FIG. 3. It is preferably to cover the rear side of the mirror 1 with a transparent light diffusing layer 13 at least along the lines 12 and within the region of the graphic design 14, so that it is not possible to see the rear surface of the mirror 1 directly through the lines 12. The light diffusing layer 13 is preferably a transparent colored paint mixed with a diffusing agent. And as shown in FIG. 5, it is constituted by line segments of different colors so that there is a rich variety of colors. For instance, referring to FIG. 5, a yellow (Y) paint may be sprayed first and a red (R) paint is sprayed thereafter so that the overlapping portions will have the color orange (O).

A series of colored light sources 2 are hidden in the cabinet 6 at the rear side of the mirror 1 and are controlled by a central control device 3. Each colored light source 2 is preferably composed of a plurality of miniature colored light bulbs 20 such as those used in decorating the Christmas trees. The light bulbs 20 may be configured to flash simultaneously or alternately. With reference to FIGS. 3 and 4, the light bulbs 20 of each colored light source 2 are alternately arranged at corresponding positions behind the mirror 1. Preferably, a plastic plate 62 is used to secure the light bulbs 20 in place. In order to enhance marketability of the mirror products according to the present invention, referring to FIG. 4, a sound generating means 4 using a buzzer or other sound emitting elements may further be provided to connect to the central control device 3. By means of this arrangement, the colored light sources 2 and the sound generating means 4 may be controlled by the central control device 3 to synchronously generate rich sound and lighting effects.

The central control device 3 obtains power via an electrical plug 41 extending to an outer wall of the cabinet 6 and the control procedures may be selected to proceed automatically via a switch 42 or the switch 42 may be manually operated to carry out the procedures one by one. Each change in sound/light control is controlled via the switch 42 which, to those skilled in the art of electronics, may be a sound- or light-control switch, or any other remote-control switches.

Figure 9:
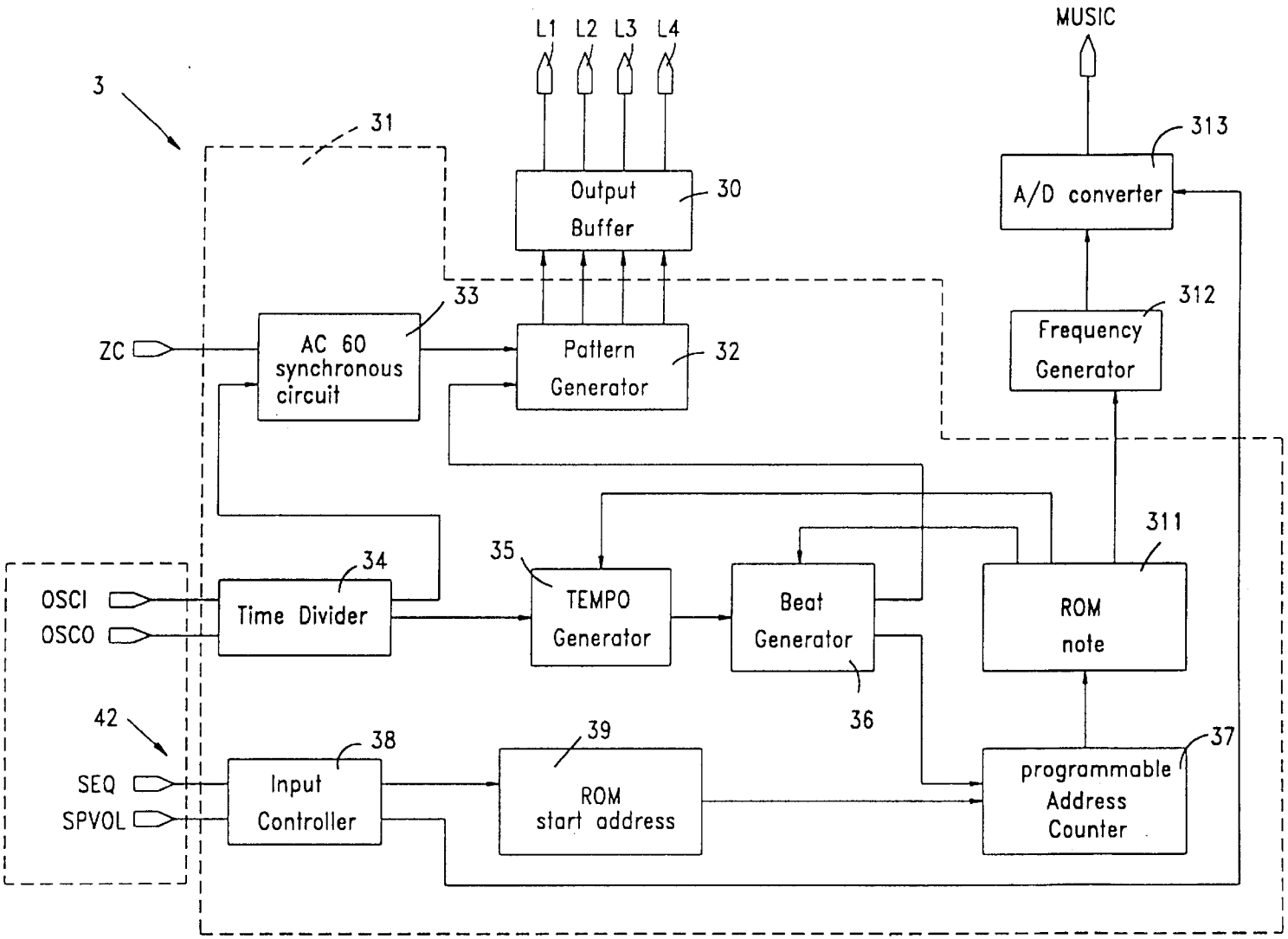
FIG. 9 is a block diagram of a preferred embodiment of the central control device.

With reference to FIG. 9, the central control device 3 essentially includes a central processing unit 31, and an input interface connected thereto, which may be constituted by a series of switches for inputting a selection signal to the central processing unit 31. By means of a driver or an output buffer 30, the processed signal may enable light sources L1–L4 to obtain power and operate. The output buffer 30 in FIG. 9 is driven by a pattern signal output from a pattern generator 32. Electrical currents flow via a terminal ZC into a synchronous circuit 33 to provide power supply. The oscillation frequency terminals CSCI and CSCO of the input interface are connected to a time divider 34 to divide the time signals, which are processed by a tempo generator 35 and a beat generator 36 into a beat difference. At the same time, a selected standard reference pulse is output to a programmable address counter 37. On the other hand, the procedures of the switch 42 or a signal input via the volume control terminal SEQ or SPVOL are/is sent by an input controller 38 to a ROM start address 39 which outputs a sampled signal to the programmable address counter 37 for processing. Then the sampled pulse is sent to a ROM note 311. The signal generated by the ROM note 311 may be independently sent via the beat generator 36 to the pattern generator 32 to change and selectively operate different light sets. Alternatively, signals may be generated synchronously to produce a frequency via a frequency generator 312, and the frequency may be converted via an A/D converter 313 into a digitized signal and sent to the sound generating means 4 to generate music.

Figure 7:
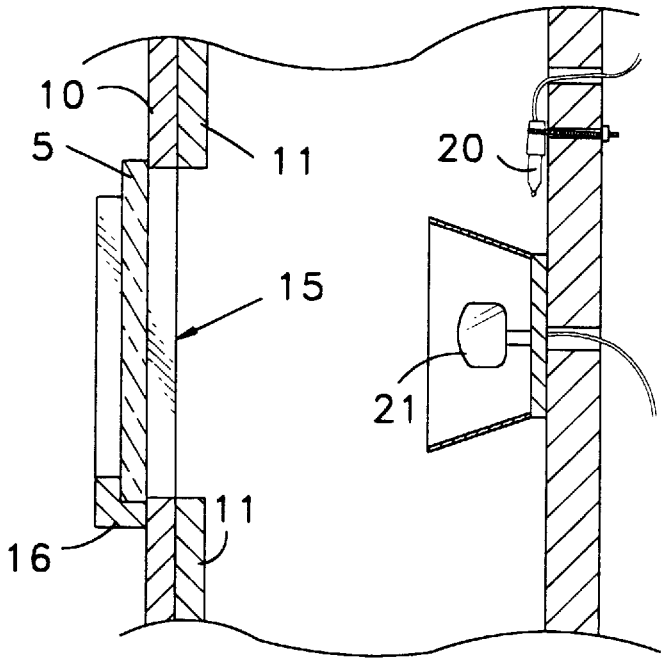
FIG. 7 is a sectional view taken along line A—A of FIG. 1.

Another preferred embodiment is shown in FIG. 7. A blank space 15 is arranged at a corner of the mirror 1 at, for instance, an upper central portion. The reflective layer 11 does not extend to the blank space 15. A frame 16 is secured around the blank space 15 at the front surface of the mirror 1 for mounting a slide 5. Relative to the blank space 15 at the rear side of the mirror 1, a light source 21 having a high level of brilliance may be disposed to display the image on the slide 5. Certainly, the light source 21 may be connected to the central control device 3.

The above-mentioned colored light sources 2 or the light source 21 with high level of brilliance may selectively exhibit any one of the following changes via the control of the central control device 3:

1. All lights on, or all lights simultaneously flash.

2. All lights "fade in" and then "fade out," or each series "fades in" and then "fades out" in turn.

3. Select the manner mentioned in either option 1, or 2, and the brilliance of lights are controlled to be at a middle level.

4. Each light bulb or each series of light bulbs are caused to "fade in." When this manner is used in conjunction with a graphic design of lines and stars as shown in FIG. 3, a beautiful fireworks scene may be achieved.

Since the lines are colored and the light sources at the rear side of the mirror 1 constantly change colors, the graphic design may display magnificent changing light and visual effects. In particular, if the lines are wide enough, referring to FIGS. 6A and 6B, the lines may have different colors when viewed from different angles. For instance, in FIG. 6A, when light sources of three different colors, namely orange red, green, and violet blue, are on, the line 12A at the left side viewed from a central position in front of the mirror 1 will display essentially an orange color, while the line 12B will have essentially a green color, and the line 12C at the right side is essentially violet. But when these lines are viewed from the left, line 12A will be orange yellow, line 12B light green, and 12C deep blue. When viewed from the right, line 12A will be yellow, line 12B white, and 12C red. Likewise, when only two light bulbs G with either O or V are on, referring to FIG. 6B, the lines 12 will still display different colors when viewed from different angles.

If a track 60 is provided in the cabinet 6, as shown in FIGS. 3 and 4, and an opening 61 is formed at an upper part (or a lateral side) of the cabinet 6 along the track 60, the mirror 1 may be inserted into or removed from the cabinet 6. By means of this arrangement, the cabinet 6 may be used in conjunction with replaceable mirrors 1 having different graphic designs to provide greater variety.

Figure 8:
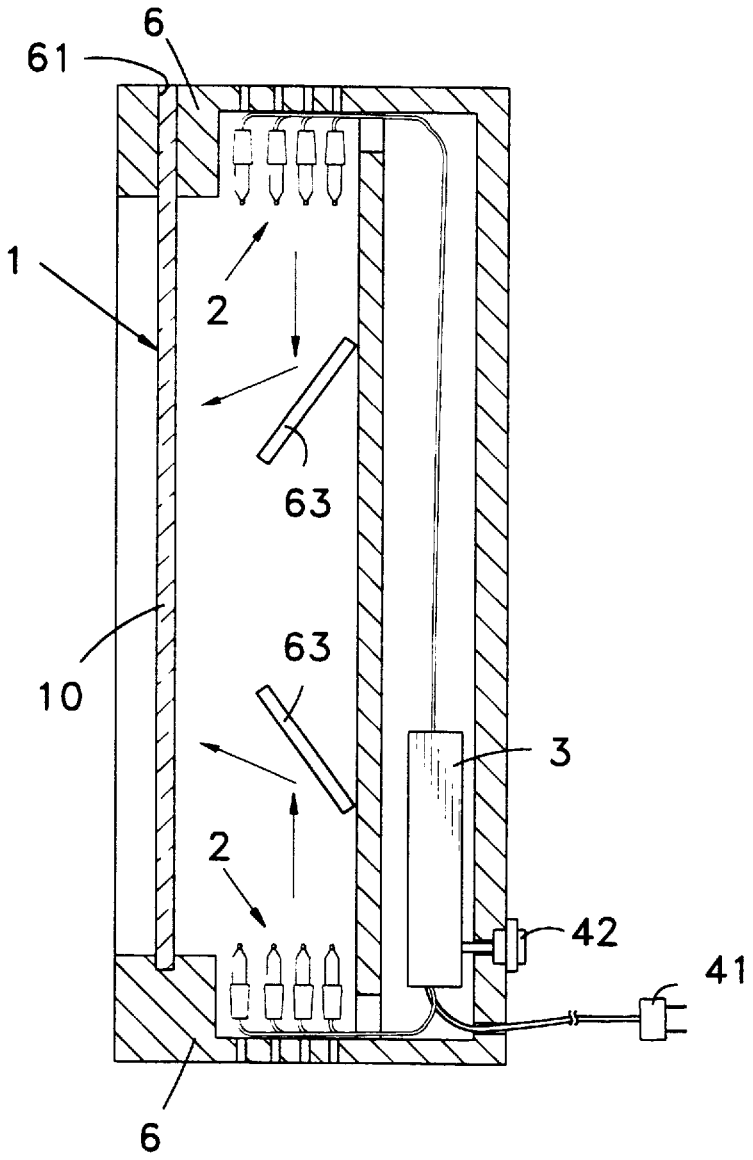
FIG. 8 is similar to FIG. 4 but showing a third preferred embodiment of the present invention.

Still another preferred embodiment is shown in FIG. 8. The light bulbs may be hidden around the interior of the cabinet 6, and a refracting means 63 may be mounted behind the mirror 1 so that the light from the light bulbs may refract to the mirror 1. Convergent lenses and prisms may further be used as refracting elements to achieve richer light and color alterations.

Aside from utilizing lines of different colors to constitute the graphic design and colored light sets at the rear side of the mirror to create a beautiful pattern of colors and light, the present invention employs the central control device 3 to control operation of the light bulbs and their level of brilliance so as to provide fascinating visual and light effects. In particular, the lines forming the graphic design are wide enough to allow the graphic design to be always visible from the front side of the mirror and further to allow the graphic design to display different colors when viewed from different angles. Furthermore, the mirrors are replaceable so that mirrors having different graphic designs may be inserted into or removed from the cabinet to achieve greater variety.

Although the present invention has been illustrated and described with reference to the preferred embodiments thereof, it should be understood that it is in no way limited to the details of such embodiments, but is capable of numerous modifications within the scope of the appended claims.

What is claimed is:

1. A phantom color light mirror, comprising:

a mirror having a transparent sheet, a reflective layer affixed to a rear surface of said transparent sheet, and a line having a width of at least 0.3 mm engraved into said reflective layer to form a graphic design so that said graphic design may be visible through said transparent sheet;

a plurality of colored light sources arranged on a side of said reflective layer opposite said transparent sheet;

a central control device connected to said colored light sources and controlling electrical currents thereto to control the operation thereof; and a transparent light-diffusing layer covers an area of the side of said reflective layer opposite said transparent sheet where said graphic design is located, said light-diffusing layer is a colored layer, said light-diffusing layer is constituted by a plurality of line segments of different colors.

2. A phantom color light mirror, comprising:

a mirror having a transparent sheet, a reflective layer affixed to a rear surface of said transparent sheet, and a line having a width of at least 0.3 mm engraved into said reflective layer to form a graphic design so that said graphic design may be visible through said transparent sheet;

a plurality of colored light sources arranged on a side of said reflective layer opposite said transparent sheet; and a central control device connected to said colored light sources and controlling electrical currents thereto to control the operation thereof; and said gin said graphic design forms a border around said mirror.

3. A phantom color light mirror, comprising:

a mirror having a transparent sheet, a reflective layer affixed to a rear surface of said transparent sheet, and a line having a width of at least 0.3 mm engraved into said reflective layer to form a graphic design so that said graphic design may be visible through said transparent sheet;

a plurality of colored light sources arranged on a side of said reflective layer opposite said transparent sheet;

a central control device connected to said colored light sources and controlling electrical currents thereto to control the operation thereof;

a cabinet for accommodating said mirror, said plurality of colored light sources and said central control device, said cabinet is provided with a track and an opening is provided along said track for insertion or removal of said mirror into or from said cabinet, wherein said track runs in a horizontal direction and said opening is along a vertical side of said mirror.

4. A phantom color light mirror, comprising:

a mirror including a transparent sheet having a blank space in a corner of said transparent sheet, a reflective layer affixed to a rear surface of said transparent sheet around said blank space, a line having a width of at least 0.3 mm engraved into said reflective layer to form a graphic design so that said graphic design may be visible through said transparent sheet, and a frame mounted on said transparent sheet around said blank space for mounting therein a slide;

a plurality of colored light sources arranged on a side of said reflective layer opposite said transparent sheet;

a light source located on a side of said transparent sheet opposite said frame to project light through the blank space;

a central control device connected to said colored light sources and controlling electrical currents thereto to control the operation thereof; and a transparent light-diffusing layer covers an area of the side of said reflective layer opposite said transparent sheet where said graphic design is located, said light-diffusing layer is a colored layer, said light-diffusing layer is constituted by a plurality of line segments of different colors.

5. A phantom color light mirror, comprising:

a mirror including a transparent sheet having a blank space in a corner of said transparent sheet, a reflective layer affixed to a rear surface of said transparent sheet around said blank space, a line having a width of at least 0.3 mm engraved into said reflective layer to form a graphic design so that said graphic design may be visible through said transparent sheet, and a frame means for holding a slide, said frame means mounted on said transparent sheet, wherein said frame means borders only said blank space;

a plurality of colored light sources arranged on a side of said reflective layer opposite said transparent sheet, each of said plurality of colored light sources are provided with a plurality of miniature light bulbs which may be simultaneously or alternately on;

a light source located on a side of said transparent sheet opposite said frame to project light through the blank space; and a central control device connected to said colored light sources and controlling electrical currents thereto to control the operation thereof.

* * * * *